US009517368B2

(12) United States Patent
Eltringham et al.

(10) Patent No.: US 9,517,368 B2
(45) Date of Patent: Dec. 13, 2016

(54) ENTRY/EXIT GATE ASSEMBLY OF A FALL PROTECTION SYSTEM

(71) Applicant: Capital Safety Group (Northern Europe) Limited, Redditch, Worcestershire (GB)

(72) Inventors: Steven Eltringham, Redditch (GB); Robert Hirst, Stourbridge (GB)

(73) Assignee: Capital Safety Group (Northern Europe) Limited, Redditch (GB)

( * ) Notice: Subject to any disclaimer, the term of this patent is extended or adjusted under 35 U.S.C. 154(b) by 120 days.

(21) Appl. No.: 14/174,204

(22) Filed: Feb. 6, 2014

(65) Prior Publication Data

US 2015/0217148 A1 Aug. 6, 2015

(51) Int. Cl.
*A62B 35/00* (2006.01)

(52) U.S. Cl.
CPC ..... *A62B 35/0068* (2013.01); *A62B 35/0062* (2013.01); *A62B 35/0081* (2013.01)

(58) Field of Classification Search
CPC ..... E06B 11/02; E06B 11/023; E06B 11/026
See application file for complete search history.

(56) References Cited

U.S. PATENT DOCUMENTS 2,916,244 A * 12/1959 Renfroe ..... B66C 1/64 105/154
3,217,833 A * 11/1965 Smith ..... E04G 21/3261 182/3
3,821,865 A * 7/1974 Steinke ..... 49/404
5,029,754 A 7/1991 Fränkel
5,165,499 A * 11/1992 Bell ..... A62B 35/0068 182/9
5,325,788 A 7/1994 Strickland et al.
5,343,975 A 9/1994 Riches et al.
5,361,866 A * 11/1994 Bell ..... A62B 35/005 182/3
5,526,896 A * 6/1996 O'Rourke ..... A62B 35/0068 182/3
5,529,144 A * 6/1996 Henderson ..... A62B 35/0068 182/3
6,009,973 A 1/2000 Woodyard
6,354,399 B1 3/2002 Austin
6,439,344 B1 * 8/2002 Cole ..... E04G 21/3261 182/113
6,478,112 B2 11/2002 Lee
6,520,090 B2 2/2003 Hudson
6,571,912 B2 6/2003 Söll
(Continued)

FOREIGN PATENT DOCUMENTS

CN 201684317 12/2010
CN 102145210 8/2011
(Continued)

*Primary Examiner* — Colleen M Chavchavadze
(74) *Attorney, Agent, or Firm* — Dicke, Billig & Czaja, PLLC

(57) ABSTRACT

An entry/exit gate assembly for a shuttle based fall protection system is provided. The entry/exit gate assembly includes a rail, a gate and a gate manipulation member. The rail has at least one entry/exit cutaway section. The gate is slidably engaged with the rail and the gate manipulation member coupled to selectively lock the gate in a static position in relation with the rail to block access to the at least one entry/exit cutaway section.

13 Claims, 8 Drawing Sheets

(56) References Cited

U.S. PATENT DOCUMENTS

| | | | | |
|---|---|---|---|---|
| 7,000,730 | B1 * | 2/2006 | Ostrobrod | A62B 1/04 182/3 |
| 7,416,054 | B2 * | 8/2008 | Liggett | 182/36 |
| 7,594,357 | B2 * | 9/2009 | Harrington | 49/226 |
| 7,603,952 | B2 | 10/2009 | Vetesnik | |
| 8,066,578 | B2 * | 11/2011 | Liggett | 472/136 |
| 8,181,740 | B2 | 5/2012 | Blomberg et al. | |
| 8,646,575 | B1 * | 2/2014 | Guthrie | A62B 35/0068 182/3 |
| 2001/0011694 | A1 * | 8/2001 | Lycett | A62B 35/0068 248/228.1 |
| 2006/0156645 | A1 * | 7/2006 | Munday | A62B 35/0068 52/122.1 |
| 2008/0042030 | A1 * | 2/2008 | Holling | A62B 35/0056 248/237 |
| 2010/0012426 | A1 | 1/2010 | Golden et al. | |
| 2015/0014092 | A1 * | 1/2015 | Blaise | A62B 35/0043 182/5 |

FOREIGN PATENT DOCUMENTS

| | | | |
|---|---|---|---|
| DE | 9413851 | | 11/1994 |
| EP | 1 990 072 | A1 | 11/2008 |
| GB | 2 393 206 | B | 11/2005 |
| WO | WO 99/39772 | A1 | 8/1999 |
| WO | WO 0012176 | A1 | 3/2000 |

* cited by examiner

ENTRY/EXIT GATE ASSEMBLY OF A FALL PROTECTION SYSTEM

BACKGROUND

Workers who are required to perform their tasks at heights are required to have the proper safety gear to protect against inadvertent fall events. One type of system used where the worker is required to move a significant distance to complete a task at a height is a rail system. A rail system typically includes an elongated rail and shuttle that is slidably attached to the rail. The rail is attached to a support structure. The shuttle typically includes a connection portion that is designed to allow a lifeline to be coupled to the shuttle. The safety line in turn is connected to a safety harness of a worker. It is desired to have an effective and safe method of mounting and un-mounting shuttles on the rail.

For the reasons stated above and for other reasons stated below which will become apparent to those skilled in the art upon reading and understanding the present specification, there is a need in the art for an entry/exit gate assembly of a fall protection system that is effective and safe.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, an entry/exit gate assembly is provided. The entry/exit gate assembly includes a rail, a gate and a gate manipulation member. The rail has at least one entry/exit cutaway section. The gate is slidably engaged with the rail and the gate manipulation member coupled to selectively lock the gate in a static position in relation with the rail to block access to the at least one entry/exit cutaway section.

In yet another embodiment, another entry/exit assembly is provided. The entry/exit assembly includes a rail, a gate and a gate manipulation member. The rail includes a first upper ledge and a second upper ledge. The second upper ledge extends away, in an opposed fashion, from the first upper ledge. The rail further includes a first cutaway section in the first upper ledge and a second cutaway section in the second upper ledge. The second cutaway section is aligned with the first cutaway section. The rail also has a locking bore positioned between the first upper ledge and the second upper ledge. The gate has a gate holding track. The gate holding track receives the first upper ledge and the second upper ledge to slidably mount the gate to the rail. The gate manipulation member is coupled to the gate. The gate manipulation member is configured and arranged to engage the locking bore in the rail to lock the gate in a static location relative to the rail to selectively block access to the first cutaway section in the first upper ledge and the second cutaway section in the second upper ledge of the rail.

In still another embodiment, a fall protection system is provided that includes an entry/exit assembly and a shuttle. The entry/exit assembly includes a rail, a gate and a gate manipulation member. The rail has at least one entry/exit cutaway section. The gate is slidably engaged with the rail. The gate manipulation member is coupled to selectively lock the gate in a static position in relation with the rail to block access to the at least one entry/exit cutaway section. The shuttle includes a body, at least one roller and a shuttle anchor. The body includes a mid-portion, a first side portion and a second side portion. The first side portion and the second side portion extend from opposite sides of the mid-portion at select angles. The at least one roller is rotationally coupled to each first and second side portion. The rollers and body form a receiving track that is configured and arranged to slidably receive the rail. The shuttle anchor connector is coupled to the body. The shuttle anchor connector is configured and arranged to provide a secure connection point for a lifeline.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1:
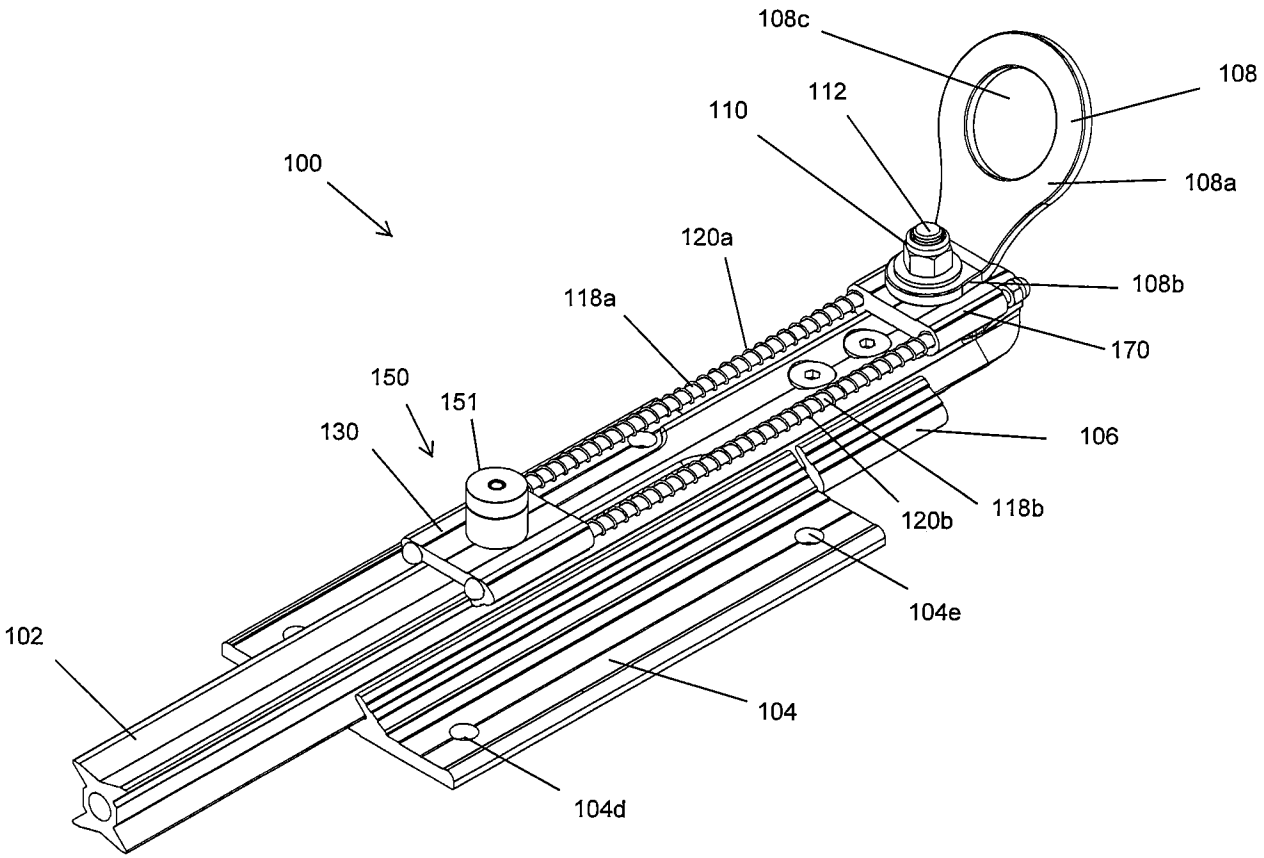
FIG. 1 is a side perspective view of entry/exit gate assembly of one embodiment of the present invention.

Embodiments of the present invention provide an entry/exit gate assembly for a fall protection system that has an improved entry/exit gate which allows a carriage to be more efficiently connected and removed from the assembly. In embodiments, the entry/exit gate assembly includes a self locking system and anchor eye that maintains secure connection when transferring to another system. Referring to the side perspective view of the entry/exit gate assembly 100 of FIG. 1 and the unassembled side perspective view of the entry/exit gate assembly 100 of FIG. 2, a description of the components of the entry/exit gate assembly 100 is provided. The entry/exit gate assembly 100 includes an entry/exit gate rail 102. The gate rail 102 is configured to be coupled to a rail system (not shown) that slidably holds a carriage 200 (or shuttle) in which a lifeline would be attached to a user working at a height. The gate rail 102 has a length that extends between a first end 102*j* and a second end 102*k* and has a generally X-shaped cross-section with a center bore 102*e*. The gate rail 102 includes opposed upper ridges 102*a* and 102*b* that hold the carriage 200 (as further discussed below) and opposed lower ridges 102*c* and 102*d*. The lower ridges 102*c* and 102*d* are received in an anchor holding track 104*c* of anchor plate 104 that is attached to a support (not shown). The anchoring plate 104 is attached to the support via fasteners (not shown) passing through anchor plate apertures 104*d*, 104*f*, 104*e* and 104*g* and engaging the support. The anchoring plate 104 includes ridges 104*a* and 104*b* that extend along a length of the anchoring plate 104 towards each other to form the anchor holding track 104*c* there between.

Figure 2:
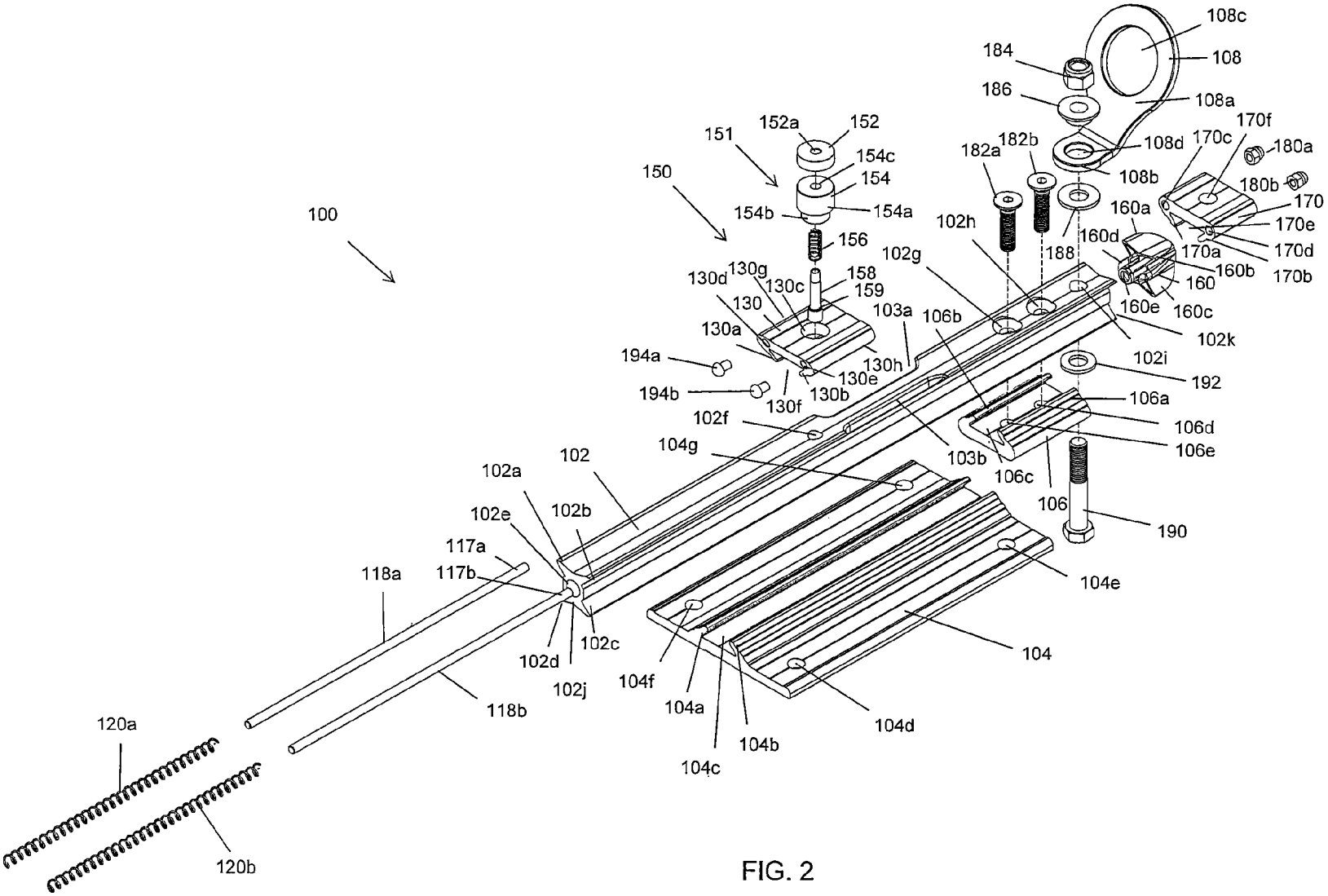
FIG. 2 is a side perspective view of the entry/exit gate assembly of FIG. 1 unassembled.

The upper ridges 102*a* and 102*b* of the gate rail 102 include a pair of aligned entry/exit cutaway sections 103*a* and 103*b*. In particular, ridge 102*a* includes a first entry/exit cutaway section 103*a* and the ridge 102*b* includes a second entry/exit cutaway section 103*b* that is aligned with the first entry/exit cutaway section 103*a*. In one embodiment, as shown in FIG. 2, the pair of the entry/exit cutaway sections 103*a* and 103*b* are positioned approximately mid-point along a length of the gate rail 102. Bored into the gate rail 102 between the upper ridges 102*a* and 102*b* is a locking bore 102*f* that is used to lock a gate assembly 150 in a static position. As illustrated in FIG. 2, the locking bore 102*f* is positioned near the pair of entry/exit cutaway sections 103*a* and 103*b* and between the first end 102*j* of the gate rail 102 and the pair of entry/exit cutaway sections 103*a* and 103*b* of the gate rail 102. The gate rail 102 further includes connecting apertures 102*g*, 102*h* and 102*i* that are positioned between the upper ridges 102*a* and 102*b* and between the entry/exit cutaway sections 103*a* and 103*b* and the second end 102*k* of the gate rail 102. The connecting apertures 102*g*, 102*h* and 102*i* are further discussed below.

As discussed above, the entry/exit gate assembly 100 includes a gate portion 150 that selectively blocks access to the entry/exit cutaway sections 103*a* and 103*b*. The gate portion 150 includes a gate manipulation member 151 and a gate 130. The gate 130 includes a gate holding track 130*f* that is designed to slidably receive the upper holding ledges 102*a* and 102*b* of the gate rail 102. The gate holding track 130*f* of the gate 130 is formed by lower ridges 130*a* and 130*b* that extends out along opposites sides of the gate 130 towards each other. Each ridge 130*a* and 130*b* extends along a length of the gate 130. The gate 130 further includes a centrally located gate manipulation member aperture 130*c* and a pair of support bar passages 130*d* and 130*e* that extend along the length of the gate 130. The support bar passages 130*d* and 130*e* are spaced a select distance apart from each other such that the first support bar passage 130*d* is positioned proximate a first side 130*g* of the gate 130 and the second support bar passage 130*e* is positioned proximate a second side 130*h* of the gate 130. The centrally located gate manipulation member 103*c* is positioned between the support bar passages 130*d* and 130*e* and extends through the gate 130 in a perpendicular fashion to the support bar passages 130*d* and 130*e*.

The gate manipulation member 151 of the gate portion 150 includes a plunger stop pin 158, a knurled knob 152, plunger stop barrel 154, a pin biasing member 156 and a gate body 130. The plunger stop pin 158 (as best illustrated in FIGS. 5B and 6B) includes a connector portion 158*a*, a mid-portion 158*b* and a locking portion 158*c*. The mid portion 158*b* is positioned between the connector portion 158*a* and the locking portion 158*c*. The plunger stop pin 158 includes a shoulder 159 that transitions between the mid-portion 158*b* and the locking portion. The connector portion 158*a* of the plunger stop pin 158 is received and coupled in a central pin aperture 152*a* (illustrated in FIG. 2) of the knob 152. The biasing member 156 is received around the mid-portion 158*b* of the plunger stop pin 158. The plunger stop barrel 154 includes a first section 154*a* and second section 154*b*. The first section 154*a* has a larger diameter than the second section 154*b*. The second section 154*b* is received and coupled in the centrally located gate manipulation member aperture 130*c* of the gate 130. The plunger stop barrel 154 also includes a central bore 154*d* (as best shown in FIG. 5B) and a central pin aperture 154*c* (as best illustrated in FIG. 2). The central pin aperture 154*c* extends into the central bore 154*d*. The plunger stop pin 158 passes through the central pin aperture 154*c* into the central bore 154*d* of the plunger stop barrel 154. In particular, as illustrated in FIGS. 5B and 6B, the mid-portion 158*b* of the plunger stop pin 158 is positioned to pass through the central pin aperture 154*c* into the central bore 154*d* of the plunger stop barrel 154. The pin biasing member 156 that is positioned around the mid-portion 158*b* of the plunger stop pin 158 has a first end that abuts an inner surface of the central bore 154*d* of the plunger stop barrel 154 around the central pin aperture 154*c*. A second end of the pin biasing member 156 abuts the shoulder 159 of the plunger stop pin 158 therein asserting a biasing force on the plunger stop pin 158 out of the central bore 154*d* of the plunger stop barrel 158. The locking portion 158*c* of the plunger stop pin 158 is sized to fit within the locking bore 102*f* of the gate rail 102 to selectively lock the gate portion 150 in a static position to block the entry/exit cutaway sections 103*a* and 103*b* of the gate rail 102. The pin biasing member 156 biases the locking stop portion 158*c* of the plunger stop pin 158 into the locking bore 102*f* of the gate rail 102.

The entry/exit gate assembly 100 further includes a rail body stop 106. The rail body stop 106 includes a rail stop track 106*c* that is designed to receive the lower holding ledges 102*c* and 102*d* of the rail 102. A pair of ridges 106*a* and 106*b* that extend from opposite sides of the rail body stop 106 toward each other form the rail stop track 106*c*. The rail body stop 106 further includes a pair of centrally located mounting apertures 106*e* and 106*d*. The mounting apertures 106*e* and 106*d* of the rail body stop 106 are aligned with the respective connecting apertures 102*g* and 102*h* in the rail 102. Fasteners 182*a* and 182*b* passing through the respective mounting apertures 106*e* and 106*d* of the rail body stop 106 and connecting apertures 102*g* and 102*h* in the rail 102 mount the rail body stop 106 to the rail 102. The rail body stop 106 coupled to the rail 102 limits movement of the rail 102 in relation to the mounting plate 104.

The entry/exit gate assembly 100 also includes a bias body stop 170. The bias body stop 170 includes bias stop track 170*e* that is designed to receive the upper holding ledges 102*a* and 102*b* of the rail 102. A pair of ridges 170*a* and 170*b* that extend from opposite sides of the bias body stop 170 toward each other, form the bias stop track 170*e*. The bias body stop 170 includes a central connecting aperture 170*f* that is centrally positioned between the sides of the bias body stop 170. The bias body stop 170 receives the upper holding ledges 102*a* and 102*b* of the rail 102 and is positioned on the rail 102 so that the central connecting aperture 170*f* is aligned with connecting aperture 102*i* of the rail 102. A fastener 190 passing through the central connecting aperture 170*f* of the bias body stop 170 and connecting aperture 102*i* of the rail 102 couples the bias body stop 170 to the rail 102. The bias body stop 170 further includes a pair of spaced support bar passages 170*c* and 170*d*. Each support bar passage 170*c* and 170*d* extends throughout a length of the bias body stop 170 proximate a respective side of the bias body stop 170. Moreover, the central connecting aperture 170*f* is positioned between the support bar passages 170*c* and 170*d* and has a perpendicular path in relation to the support bar passages 170*c* and 170*d*.

The entry/exit gate assembly 100 also includes a stationary lifeline connector 108. The stationary connector 108 allows an operator to temporarily attach a lifeline connector (not shown) to the entry/exit gate assembly 100 when removing or mounting a shuttle 200 (which has another lifeline connector as discussed below). The stationary lifeline connector 108 in this embodiment has a first portion 108*a* and a second portion 108*b*. The second portion 108*b* extends from the first portion 108*a* a select angle. The second portion 108*b* includes a connecting aperture 108*d* that is aligned with the connecting aperture 170*f* of the bias body stop 170. The fastener 190 also passes through the connecting aperture 108*d* of the stationary lifeline connector 108 to fasten the stationary lifeline connector 108 to the rail 102. In particular, the fastener 190 uses a nut 184 to engage threads of the fastener 190 and washers 186, 188, and 192 to couple the bias body stop 170 and the stationary lifeline connector 108 to the rail 102. The first portion 108*a* (an anchoring eye) includes an anchoring eye aperture 108*c*. The anchoring eye 108 is designed to selectively receive a lifeline connector as discussed above. The entry/exit gate assembly 100 further includes an end cap 160. The end cap 160 includes upper ledges 160*a*, 160*b* that extend upper ledges 102*a* and 102*b* of the rail 102 and lower ledges 160*c* and 160*d* that extend lower ledges 102*c* and 102*d* of the rail 102. The end cap 160 also includes a center post 160*e* that fits within the center bore 102*e* of the rail 102. The end cap is coupled to the second end 102*k* of the rail 102.

The entry/exit gate assembly 100 further includes a pair of biasing support bars 118*a* and 118*b*. The first biasing support bar 118*a* has a first end received within support bar passage 130*d* of the gate 130. A first bar cap 194*a* is coupled in a first end of the support bar passage 130*d* to retain the first end of the first biasing support bar 118*a* within support bar passage 130*d* during use. The second biasing support bar 118*b* has a first end received within support bar passage 130*e* of the gate 130. A second bar cap 194*b* is coupled in a first end of the support bar passage 130*e* to retain the first end of the second biasing support bar 118*b* within support bar passage 130*e* during use. A second end of the first biasing support bar 118*a* is received within the first support passage 170*c* of the biasing body stop 170. A portion of the second end of the first biasing support bar 118*a* includes threads 117*a*. A nut 180*a* engaging the threads 117*a* of the first biasing support bar 118*a* retains the second end of the first support bar 118*a* in the first support passage 170*c* of the biasing body stop 170. A second end of the second biasing support bar 118*b* is received within the second support passage 170*d* of the biasing body stop 170. A portion of the second end of the second biasing support bar 118*b* includes threads 117*b*. A nut 180*b* engaging the threads 117*b* of the second biasing support bar 118*b* retains the second end of the second support bar 118*b* in the second support passage 170*d* of the biasing body stop 170. A first guide biasing member 120*a* is positioned around the first biasing support bar 118*a* between the gate 130 and the biasing body stop 170. A second guide biasing member 120*b* is positioned around the second biasing support bar 118*b* between the gate 130 and the biasing body stop 170. The first and second guide biasing members 120*a* and 120*b* assert a biasing force on the gate 130 to bias the gate 130 in a position between a carriage 200 (shown in FIG. 3) and the entry/exit cutaway sections 103*a* and 103*b* of the rail 102.

Figure 3:
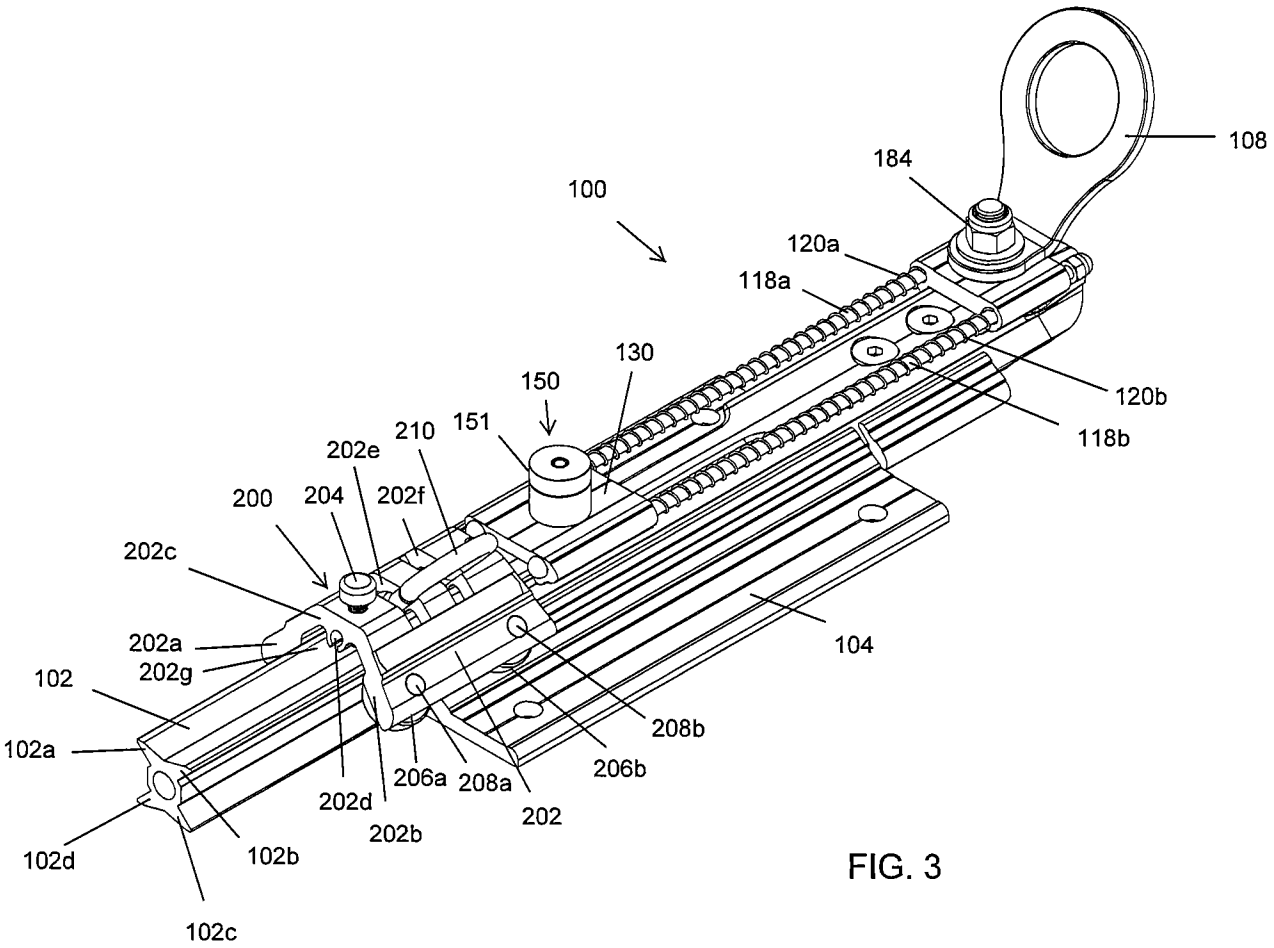
FIG. 3 is a side perspective view of the entry/exit gate assembly of FIG. 1 with a carriage of one embodiment of the present invention.

An example embodiment of a shuttle 200 (or carriage) is illustrated in FIG. 3. The shuttle 200 includes a body 202. The shuttle body 202 has a mid-portion 202*c*. Extending from opposite sides of the mid-portion 202*c* at select angles are a first side portion 202*a* and a second side portion 202*b*. A pair of rollers (only rollers 206*a* and 206*b* attached to the second side portion 202*b* are shown) are attached to each of the respective first and second side portions 202*a* and 202*b* via mounting axels 208*a* and 208*b* to form a rail receiving track 202*g*. The rail receiving track 202*g* is designed to slidably engage the upper holding ledges 102*a* and 102*b* of the rail 102. The shuttle 200 in this embodiment includes a central bore 202*d* that is positioned near the rail receiving track and extending through a length of the shuttle body 202. Also included in this embodiment is a holding member 204 that is threadably engaged within a threaded bore that extends through the shuttle body 202. The holding member 204 is designed to be rotated to engage a surface of the rail 102 to selectively prevent or restrict movement of the shuttle 200 in relation to the rail 102. This is further illustrated in FIG. 6B. FIG. 6B also illustrates holding shaft 207 that is received within the central bore 202*d* of the shuttle body 202. The holding shaft 207 is held within the central bore via the holding member 204 and locking screw 205 which is also threadably engaged to a threaded bore in the shuttle body 202. A shuttle anchoring eye 210 that is generally U-shaped has legs ends 210*a* and 210*b* that are rotationally mounted on the holding shaft 207 that is within the central bore 202*d* of the shuttle body 202. Cut out tracks 202*e* and 202*f* in the shuttle body 202 (illustrated in FIG. 3) allow the shuttle anchoring eye 210 to rotate about the holding shaft 207 a select distance. The shuttle anchoring eye 210 is designed to selectively engage a lifeline connector (not shown).

Figure 4B:
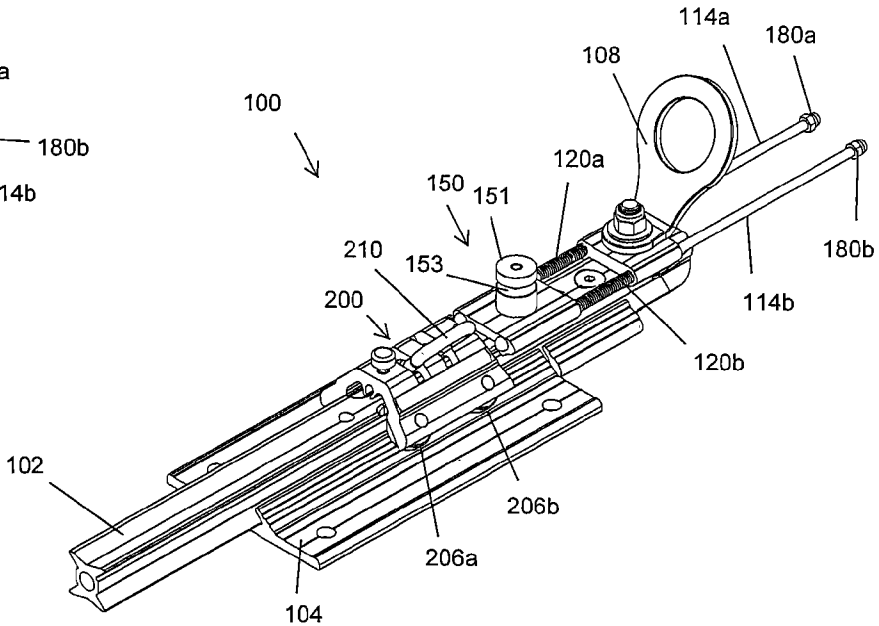
FIG. 4B is a side perspective view of the entry/exit gate assembly of FIG. 1 with the carriage received in the entry/exit cutaway sections of the entry/exit gate rail.
Figure 4A:
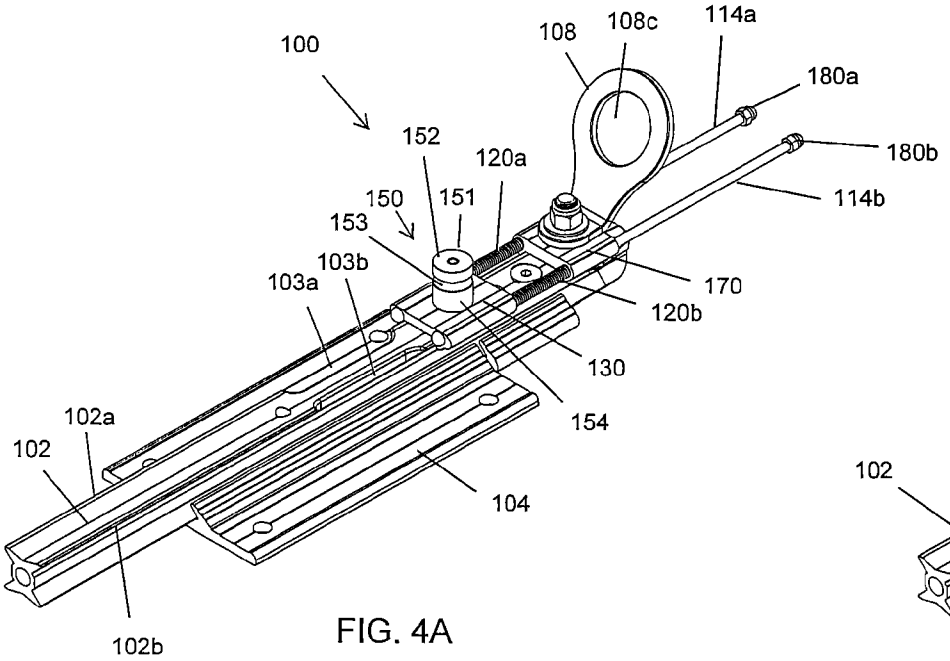
FIG. 4A is a side perspective view of the entry/exit gate assembly of FIG. 1 having it's gate positioned to expose the entry/exit cutaway sections of the entry/exit gate rail.

The entry/exit gate assembly 100 in use is illustrated in FIGS. 4A through 8B discussed below. FIG. 4A and FIG. 4B illustrate the mounting of a shuttle 200 on the rail 102. FIG. 4A illustrates the gate 130 moved back towards the biasing body stop 170 to allow access to the entry/exit cutout section 103*a* and 103*b* of the upper holding ledges 102*a* and 120*b* of the rail 102. This is accomplished by first pulling up on knob 152 of the gate portion 150 therein countering the bias force asserted by the pin biasing member 156 so that the locking portion 158*c* of the plunger stop pin 158 is lifted out of the locking bore 102*f* in the rail 102. When the knob 152 is lifted, a gap 153 is generated between the knob 152 and the plunger stop barrel 154 of the gate member 150. Once the bias force of the pin biasing member 156 is countered and the locking portion 158*c* of the plunger stop pin 158 is removed from the locking bore 120*f* of the rail 102, the gate portion 150 is moved towards the biasing body stop 170 to allow access to the entry/exit cutout section 103*a* and 103*b* of the upper holding ledges 102*a* and 120*b* of the rail 102. To move the gate portion 150 towards the biasing body stop 170, the biasing force of the first and second guide biasing member 120*a* and 120*b* have to be countered. Hence, in moving the gate portion 150 towards the biasing body stop 170 to expose the entry/exit cutout section 103*a* and 103*b* in the rail 102, two different perpendicular biasing forces (one from the pin biasing member 156 and the other from the first and second guide biasing member 120*a* and 120*b*) have to be countered to allow access to the entry/exit cutout section 103*a* and 103*b* of the upper holding ledges 102*a* and 120*b* of the rail 102. In an open position (i.e. the entry/exit cutout sections 103*a* and 103*b* of the upper holding ledges 102*a* and 120*b* of the rail 102 can be accessed), if the operator releases the gate member 150, the biasing force from the first and second guide biasing member 120*a* and 120*b* force the gate 130 of the gate member 150 to block access to the entry/exit cutout sections 103*a* and 103*b* of the rail 102 and the pin biasing member 156 force the locking portion 158*c* of the plunger stop pin 158 in the locking bore 102*f* of the rail 102. FIG. 4B illustrates the shuttle 200 positioned in the entry/exit cutout sections 103*a* and 103*b* of the rail 102 with the gate member 150 pulled back in the open position. This is how the shuttle 200 is slidably mounted on the rail 102 as well as how a shuttle is removed from the rail 102 of the entry/exit gate assembly 100 while the gate member 150 pulled back in the open position. As briefly discussed above, in use, the rail 102 of the entry/exit gate assembly 100 is coupled to an elongated rail system (not shown) that allows the shuttle to be moved along a work site to provide an anchor point in case of a fall event.

Figure 5A:
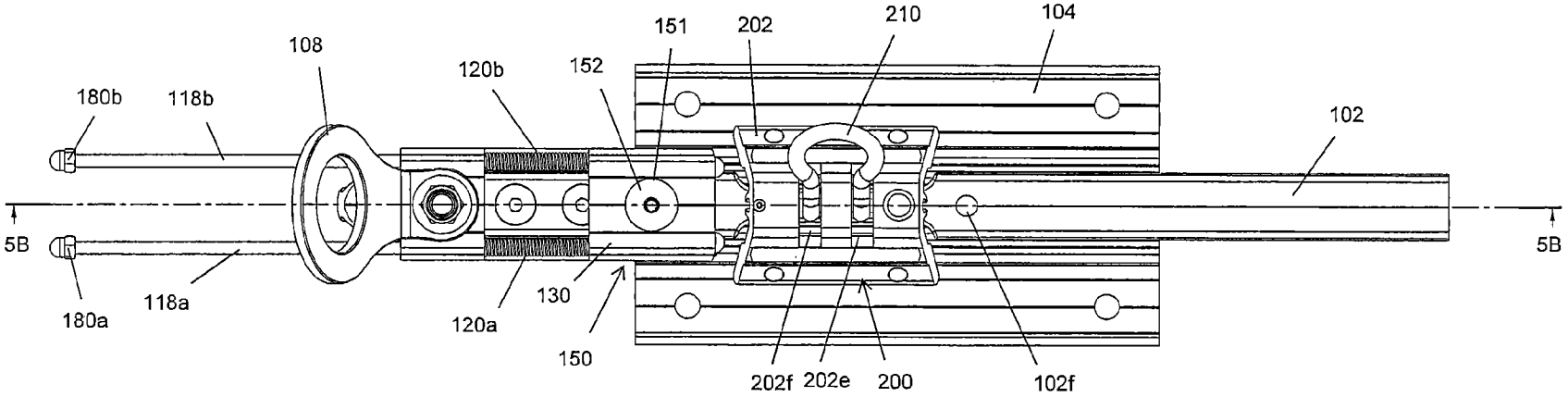
FIG. 5A is a top view of the entry/exit gate assembly of FIG. 1 with the carriage received in the entry/exit cutaway sections of the entry/exit gate rail.
Figure 5B:
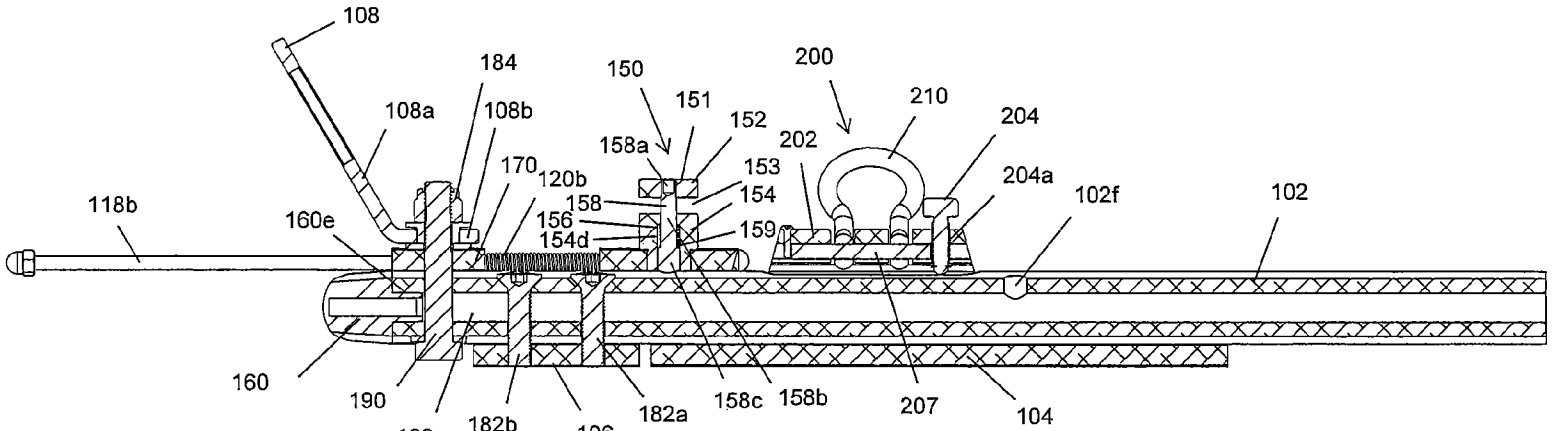
FIG. 5B is a cross-sectional side view along line 5B of FIG. 5A.

FIG. 5A illustrates a top view of the entry/exit gate assembly 100 with the gate member 150 in the open position and a shuttle 200 positioned over the entry/exit cutout sections 103*a* and 103*b* of the rail 102 which would occur when mounting a shuttle 200 or removing a shuttle 200 from the rail 102. FIG. 5B is a cross-sectional side view along line 5B of FIG. 5A. As FIG. 5B illustrates the locking portion 158*c* of the plunger stop pin 158 of the gate member 150 is out of the locking bore 102*f* of the rail 102. In this illustration, the second guide biasing member 120*b* is compressed to move the gate member 150 away so the shuttle is positioned over the entry/exit cutout sections 103*a* and 103*b* of the rail 102 to mount or remove the shuttle 200.

Figure 6A:
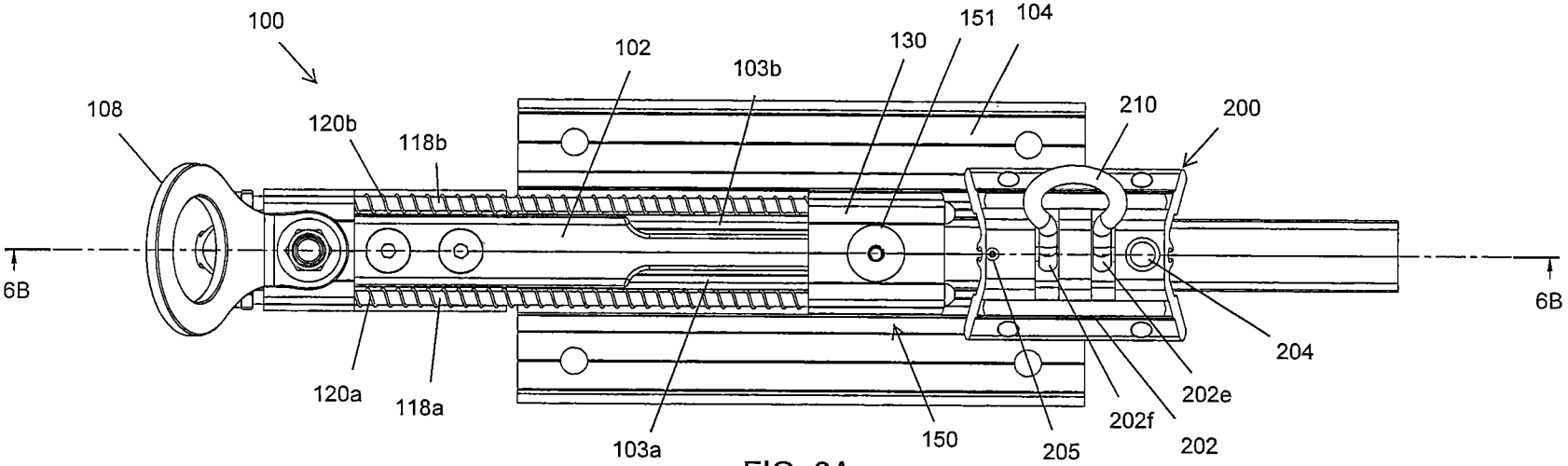
FIG. 6A is a top view of the entry/exit gate assembly of FIG. 1 with the carriage engaged with the entry/exit gate rail.
Figure 6B:
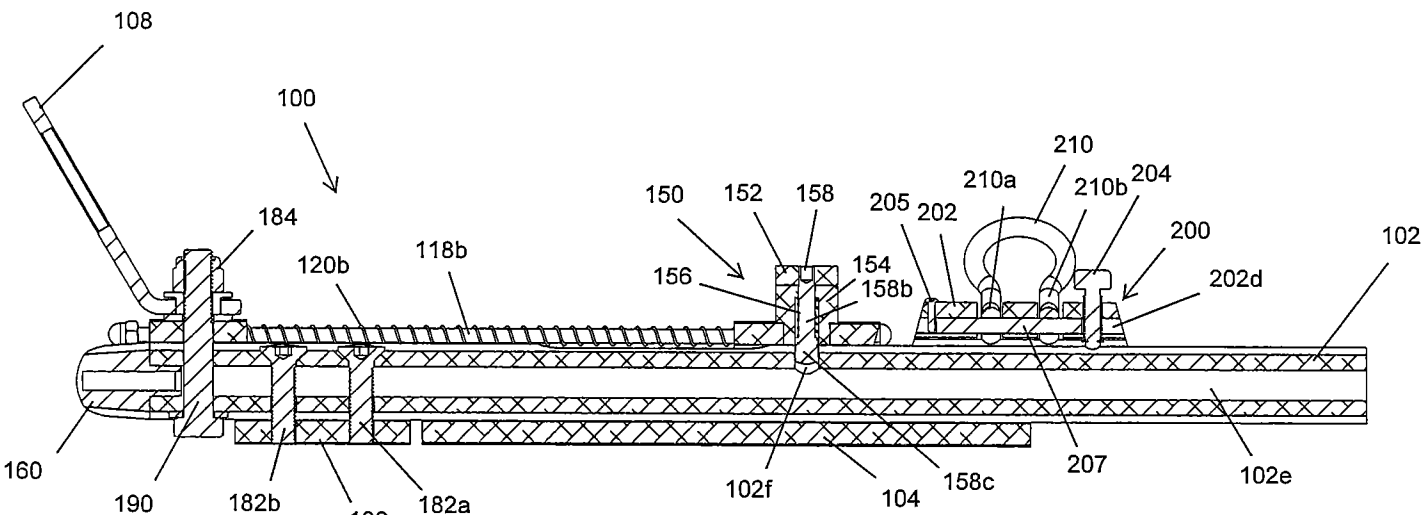
FIG. 6B is a cross-sectional side view along line 6B of FIG. 6A.
Figure 7B:
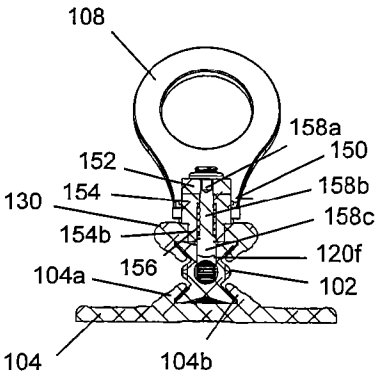
FIG. 7B is a cross-sectional front view of the entry/exit gate assembly along line 7B of FIG. 7A.
Figure 7A:
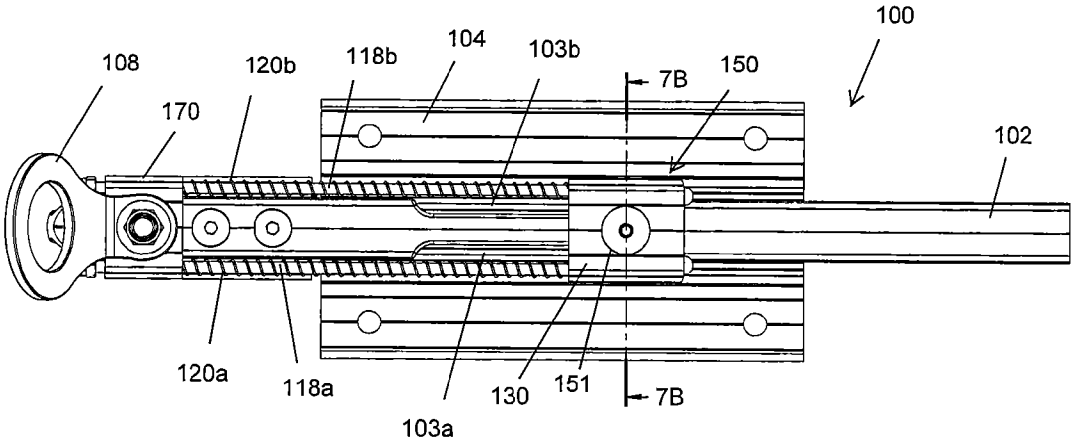
FIG. 7A is a top view of the entry/exit gate assembly of FIG. 1 with the gate member covering the entry/exit cutaway sections of the entry/exit gate rail.
Figure 8B:
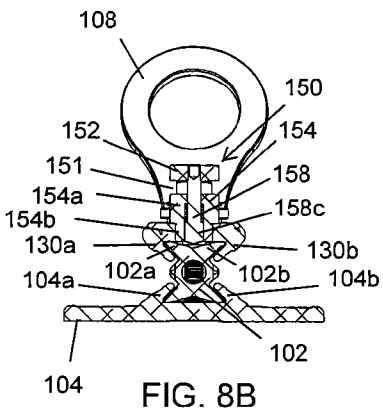
FIG. 8B is a cross-sectional front view of the entry/exit gate assembly along line 8B of FIG. 8A.
Figure 8A:
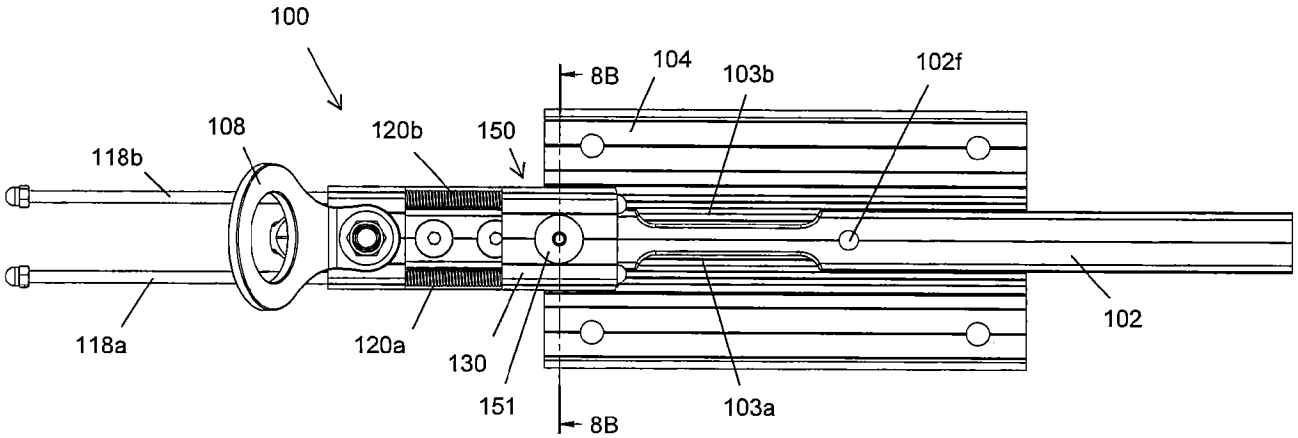
FIG. 8A is a top view of the entry/exit gate assembly of FIG. 1 with the gate member positioned to expose the entry/exit cutaway sections of the entry/exit gate rail.

FIGS. 6A and 6B illustrate the entry/exit gate assembly 100 with the gate member 150 in the closed position (the gate 130 of the gate member 150 blocking access to the entry/exit cutout sections 103*a* and 103*b* of the rail 102). FIG. 6A is a top view of the entry/exit gate assembly 100 and FIG. 6B is a cross-sectional side view of the entry/exit gate assembly 100 along line 6B of FIG. 6A. As FIG. 6B illustrates, the locking portion 158*c* of the plunger stop pin 158 of the gate member 150 is received in the locking bore 102*f* of the rail 102 to lock the gate member 150 in relation to the rail 102. In FIGS. 6A and 6B the shuttle 200 is slidably mounted on the rail 102. FIG. 7A illustrates a top view of the entry/exit gate assembly 100 with the gate member 150 in a closed position to block access to the entry/exit cutout sections 103*a* and 103*b* of the rail 102 with the gate 130. FIG. 7B illustrates a cross-section front view of the entry/exit gate assembly 100 along line 7B of FIG. 7A. As illustrated in FIG. 7B, the locking portion 158*c* of the plunger stop pin 158 of the gate member 150 is received in the locking bore 102*f* of the rail 102 to lock the gate member 150 in relation to the rail 102. FIG. 8A illustrates a top view of the entry/exit gate assembly 100 with the gate member 150 in an open position so access to the entry/exit cutout sections 103*a* and 103*b* of the rail 102 is provided to either mount or remove a shuttle 200. FIG. 8B illustrates a cross-section front view of the entry/exit gate assembly 100 along line 8B of FIG. 8A. As illustrated in FIG. 8B, the locking portion 158*c* of the plunger stop pin 158 of the gate member 150 is not received in the locking bore 102*f* of the rail 102.

Figure 9:
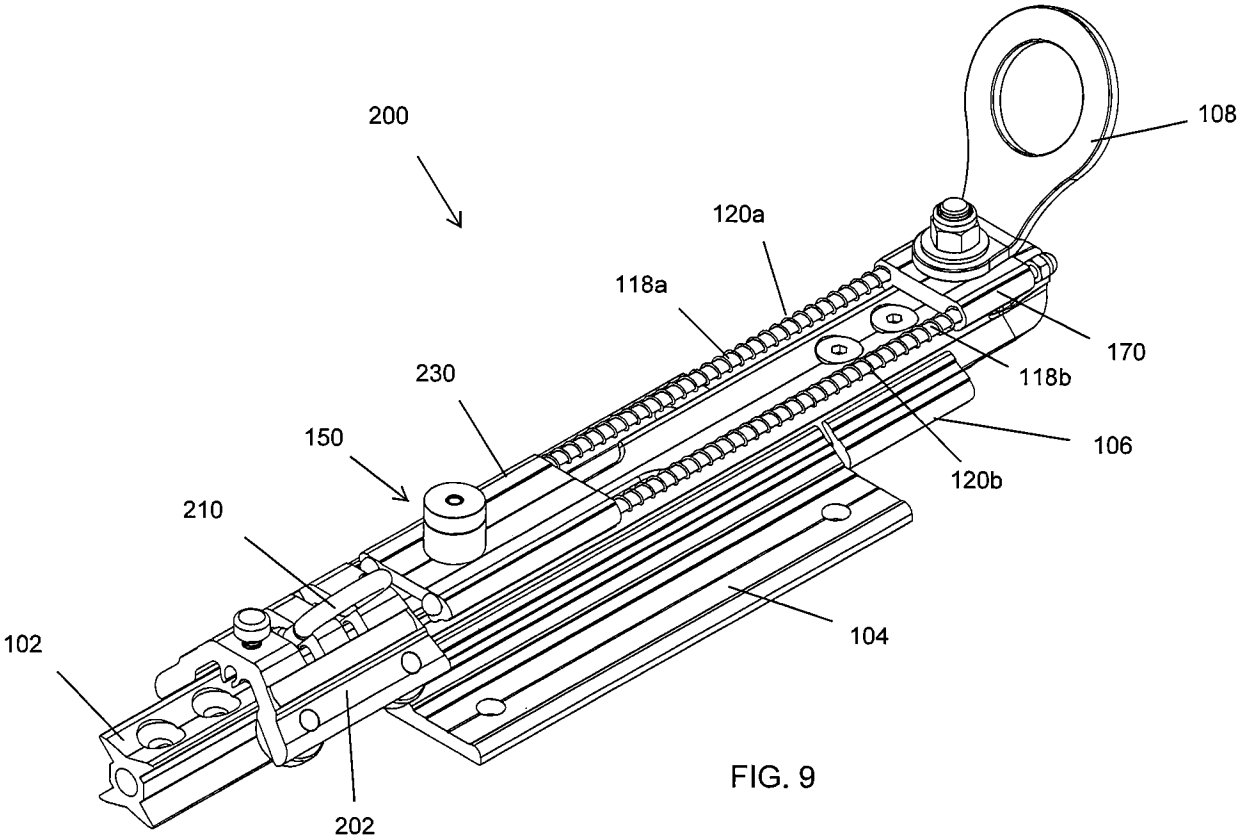
FIG. 9 is a side perspective view of entry/exit gate assembly of another embodiment of the present invention.

Referring to FIG. 9 an entry/exit gate 200 of another embodiment is illustrated. Like entry/exit gate 100 of FIG. 1, the entry/exit gate 200 includes a rail 102 upon which a carrier or shuttle 202 with a shuttle anchoring eye 210 is slideably mounted. As with the entry/exit gate 100, the entry/exit gate 200 further includes a mounting plate 104, rail body stop 106, stationary lifeline connector 108, a bias body stop 170, a pair of biasing support bars 118*a* and 118*b*, first and second guide biasing members 120*a* and 120*b* and a gate assembly 150 which are all described above. The gate assembly 150 in the entry/exit gate 200 embodiment includes a gate 230 that is longer than gate 130 of the entry/exit gate 100 described above. The longer gate 230 in this embodiment provides added support to the bias supporting bars 118*a* and 118*b*. In one embodiment, the length of the gate 130 is at least as long as the entry/exit cutaway sections 103*a* and 103*b* in the rail 102.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. An entry/exit gate assembly comprising:

a rail having a first upper ledge and a second upper ledge, the rail having at least one entry/exit cutaway section in at least one of the first upper ledge and the second upper ledge;

a gate slidably engaged about the first upper ledge and second upper ledge of the rail;

a gate manipulation member coupled to selectively lock the gate in a static position in relation with the rail to block access to the at least one entry/exit cutaway section;

a first biasing member positioned to bias the gate manipulation member in a first direction; and at least one second biasing member positioned to bias the gate in a second direction that is perpendicular to the first direction.

2. The entry/exit assembly of claim 1, further comprising:

the gate having at least one gate support bar passage;

a bias body stop coupled to the rail, the bias body stop having at least one stop support passage;

at least one biasing support bar, the at least one biasing support bar having a first end received within the at least one stop support passage, the at least one biasing support bar further passing through the at least one gate support bar passage of the gate; and at least one guide biasing member received around the at least one biasing member support bar, the at least one guide biasing member having a first end positioned to engage the gate and a second end positioned to engage the bias body stop to exert a bias force on the gate to block access to the at least one entry/exit cutaway section.

3. The entry/exit assembly of claim 1, further comprising:

a stationary connector coupled to the rail, the stationary connector configured and arranged to provide a secure connection point for a lifeline.

4. The entry/exit assembly of claim 1, further comprising:

an anchoring plate coupled to the rail, the anchoring plate configured to be coupled to a support structure upon which the rail is mounted.

5. An entry/exit gate assembly comprising:

a rail having a first upper ledge and a second upper ledge, the rail having at least one entry/exit cutaway section in at least one of the first upper ledge and the second upper ledge;

a gate slidably engaged about the first upper ledge and second upper ledge of the rail;

a gate manipulation member coupled to selectively lock the gate in a static position in relation with the rail to block access to the at least one entry/exit cutaway section;

a plunger stop pin, the plunger stop pin having a connector portion, a locking portion and a mid-portion that is positioned between the connector portion and the locking portion, the plunger stop further having a shoulder defining the locking portion from the mid-portion, the locking portion configured and arranged to be selectively received in a locking bore in the rail;

a plunger stop barrel having a central pin aperture, the mid-portion of the plunger stop pin received through the central pin aperture of the plunger stop barrel;

a knob coupled to the connector portion of the plunger stop pin, the knob configured and arranged to be grasped by a user; and a pin biasing member positioned around the mid-portion of the plunger stop pin and within the plunger stop barrel, the pin biasing member having a first end engaging an inner surface of the plunger stop barrel and a second end engaging the shoulder of the plunger stop pin, the pin biasing member asserting a bias force on the plunger stop pin towards the locking bore in the rail.

6. An entry/exit gate assembly comprising:

a rail having a first upper ledge and a second upper ledge, the rail having at least one entry/exit cutaway section in at least one of the first upper ledge and the second upper ledge;

a gate slidably engaged about the first upper ledge and second upper ledge of the rail;

a gate manipulation member coupled to selectively lock the gate in a static position in relation with the rail to block access to the at least one entry/exit cutaway section;

an anchoring plate coupled to the rail, the anchoring plate configured to be coupled to a support structure upon which the rail is mounted;

the rail having a first lower ledge and a second lower ledge extending away in an opposed fashion from the first lower ledge;

the anchoring plate having an anchoring track configured and arranged to receive the first lower ledge and the second lower ledge to couple the rail to the anchoring plate;

a rail body stop having a stop track configured and arranged to receive the rail, the rail body stop further including at least one mounting aperture that is aligned with a connecting aperture in the rail; and at least one fastener passing through the mounting aperture of the rail body stop and the connecting aperture of the rail to couple the rail body stop to the rail wherein the rail body stop limits movement of the rail in relative to the anchoring plate.

7. An entry/exit assembly comprising:

a rail, the rail including a first upper ledge and a second upper ledge, the second upper ledge extending away in an opposed fashion from the first upper ledge, the rail further including a first cutaway section in the first upper ledge and a second cutaway section in the second upper ledge, the second cutaway section being aligned with the first cutaway section, the rail further also having a locking bore positioned between the first upper ledge and the second upper ledge;

a gate having a gate holding track, the gate holding track receiving the first upper ledge and the second upper ledge to slidably mount the gate to the rail; and a gate manipulation member coupled to the gate, the gate manipulation member configured and arranged to engage the locking bore in the rail to lock the gate in a static location relative to the rail to selectively block access to the first cutaway section in the first upper ledge and the second cutaway section in the second upper ledge of the rail.

8. The entry/exit assembly of claim 7, further comprising:

a first biasing member positioned to bias the gate manipulation member to engage the locking bore in the rail; and at least one second biasing member positioned to bias the gate to a position that blocks the access to the first cutaway section in the first upper ledge and the second cutaway section in the second upper ledge of the rail.

9. The entry/exit assembly of claim 7, wherein the gate manipulation member further comprises:

a plunger stop pin, the plunger stop pin having a connector portion, a locking portion and a mid-portion that is positioned between the connector portion and the locking portion, the plunger stop further having a shoulder defining the locking portion from the mid-portion, the locking portion configured and arranged to be selectively received in a locking bore in the rail;

a plunger stop barrel having a central pin aperture, the mid-portion of the plunger stop pin received through the central pin aperture of the plunger stop barrel;

a knob coupled to the connector portion of the plunger stop pin, the knob configured and arranged to be grasped by a user;

a pin biasing member positioned around the mid-portion of the plunger stop pin and within the plunger stop barrel, the pin biasing member having a first end engaging an inner surface of the plunger stop barrel and a second end engaging the shoulder of the plunger stop pin, the pin biasing member asserting a bias force on the plunger stop pin towards the locking bore in the rail.

10. The entry/exit assembly of claim 7, further comprising:

the gate having at least one gate support bar passage;

a bias body stop coupled to the rail, the bias body stop having at least one stop support passage;

at least one biasing support bar, the at least one biasing support bar having a first end received within the at least one stop support passage, the at least one biasing support bar further passing through the at least one gate support bar passage of the gate; and at least one guide biasing member received around the at least one biasing member support bar, the at least one guide biasing member having a first end positioned to engage the gate and a second end positioned to engage the bias body stop to exert a bias force on the gate to selectively block access to the first cutaway section in the first upper ledge and the second cutaway section in the second upper ledge of the rail.

11. The entry/exit assembly of claim 7, further comprising:

the gate having a first support bar passage and a second support bar passage, the second bar passage being parallel to the first bar passage at a spaced distance;

a bias body stop coupled to the rail, the bias body stop having a first stop support passage and a second stop support passage, the first stop support passage of the bias body stop aligned with the first support bar passage of the gate and the second stop support passage of the bias body stop aligned with the second support bar passage of the gate;

a first biasing support bar, the first biasing support bar having a first end received within the first stop support passage of the bias body stop, the first biasing support bar further passing through the first gate support bar passage of the gate;

a second biasing support bar, the second biasing support bar having a first end received within the second stop support passage of the bias body stop, the second biasing support bar further passing through the second gate support bar passage of the gate;

a first guide biasing member received around the first biasing member support bar, the first guide biasing member having a first end positioned to engage a first portion of the gate and a second end positioned to engage a first portion of the bias body stop;

a second guide biasing member received around the second biasing member support bar, the second guide biasing member having a first end positioned to engage a second portion of the gate and a second end positioned to engage a second portion of the bias body stop, the first guide biasing member and the second guide biasing member configured to exert a bias force on the gate to selectively block access to the first cutaway section in the first upper ledge and the second cutaway section in the second upper ledge of the rail.

12. The entry/exit assembly of claim 7, further comprising:

a stationary connector coupled to the rail, the stationary connector configured and arranged to provide a secure connection point for a lifeline.

13. The entry/exit assembly of claim 7, further comprising:

the rail having a first lower ledge and a second lower ledge extending away in an opposed fashion from the first lower ledge;

an anchoring plate having an anchoring track configured and arranged to receive the first lower ledge and the second lower ledge to couple the rail to the anchoring plate;

a rail body stop having a stop track configured and arranged to receive the rail, the rail body stop further including at least one mounting aperture that is aligned with a connecting aperture in the rail; and at least one fastener passing through the mounting aperture of the rail body stop and the connecting aperture of the rail to couple the rail body stop to the rail wherein the rail body stop limits movement of the rail relative to the anchoring plate.

* * * * *